US007977524B2

(12) United States Patent
McCoy et al.

(10) Patent No.: US 7,977,524 B2
(45) Date of Patent: Jul. 12, 2011

(54) PROCESS FOR DECOKING A FURNACE FOR CRACKING A HYDROCARBON FEED

(75) Inventors: James N. McCoy, Houston, TX (US); Richard Charles Stell, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 563 days.

(21) Appl. No.: 11/953,307

(22) Filed: Dec. 10, 2007

(65) Prior Publication Data

US 2008/0207974 A1 Aug. 28, 2008

Related U.S. Application Data

(60) Provisional application No. 60/902,769, filed on Feb. 22, 2007.

(51) Int. Cl.
*C07C 4/00* (2006.01)

(52) U.S. Cl. ..... 585/652; 585/648; 422/105; 422/188; 422/194; 208/48 Q; 208/85

(58) Field of Classification Search ..... 585/648, 585/652; 422/105, 188, 194; 208/48 Q, 208/85

See application file for complete search history.

(56) References Cited

U.S. PATENT DOCUMENTS

| | | | | |
|---|---|---|---|---|
| 5,536,390 | A | 7/1996 | Herrmann | |
| 2005/0261532 | A1 | 11/2005 | Stell et al. | |
| 2005/0277797 | A1 | 12/2005 | Maeda et al. | |
| 2006/0014992 | A1 * | 1/2006 | Stell et al. | 585/648 |
| 2006/0249428 | A1 | 11/2006 | Stell et al. | |

FOREIGN PATENT DOCUMENTS

| | | |
|---|---|---|
| GB | 1306962 | 12/1973 |

* cited by examiner

*Primary Examiner* — Prem C Singh

(57) ABSTRACT

A process for decoking a convection section of a furnace for cracking a hydrocarbon feed, the furnace comprising a radiant section having burners that generate radiant heat and hot flue gas, and the convection section having at least one heat exchange tube for conveying the hydrocarbon feed. The process includes the step of establishing a flue gas temperature within the convection section of the furnace immediately adjacent the at least one convection section heat exchange tube so as to effect a film surface temperature of less than about 540° C. (about 1000° F.) within at least one convection section heat exchange tube, wherein said flue gas temperature establishing step is effective to decoke the at least one convection section heat exchange tube. A process for cracking hydrocarbon feed in a furnace is also provided.

22 Claims, 1 Drawing Sheet

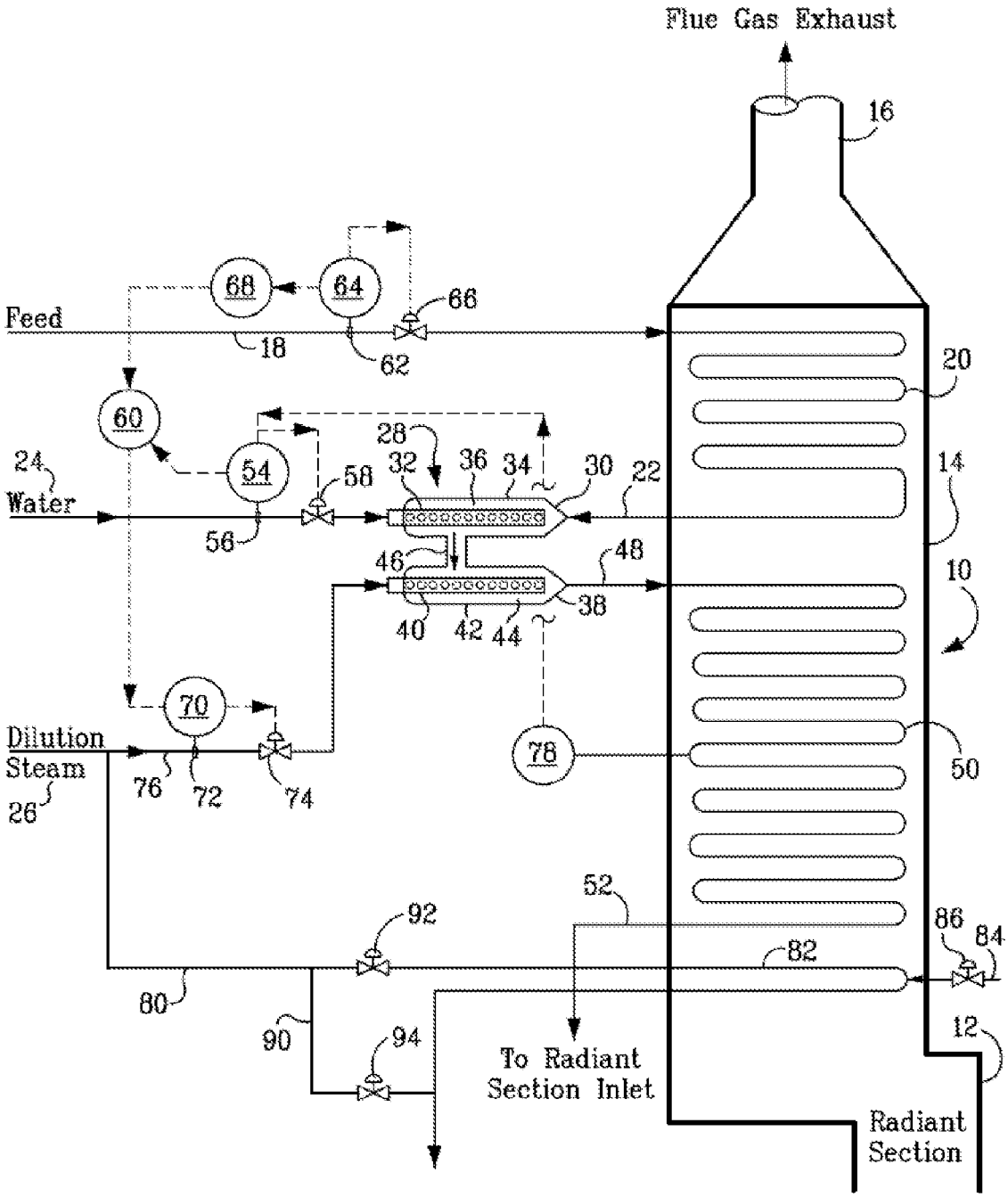
Flue Gas Exhaust
16
68
64
66
Feed
18
62
20
60
28
24
54
32
36
34
30
22
14
Water
58
56
46
48
10
38
40
42
44
70
Dilution
Steam
26
76
72
74
78
50
52
92
86
84
82
80
90
94
12
To Radiant
Section Inlet
Radiant
Section

PROCESS FOR DECOKING A FURNACE FOR CRACKING A HYDROCARBON FEED

PRIORITY CLAIM

This application claims priority to and the benefit of U.S. Ser. No. 60/902,769, filed Feb. 22, 2007.

FIELD OF THE INVENTION

The present invention relates to the field of thermal cracking of hydrocarbons for the production of olefins, particularly low molecular weight olefins such as ethylene. More particularly this invention relates to the removal of coke deposits that form during such a thermal cracking process.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products comprising olefins leave the pyrolysis furnace for further downstream processing, including quenching.

Olefin gas cracker systems are normally designed to crack ethane, propane and on occasion butane, but typically lack the flexibility to crack heavier liquid feedstocks, particularly those that produce tar in amounts greater than one percent. As gas feeds tend to produce little tar, primary, secondary, and even tertiary transfer line exchangers (TLEs) are utilized to recover energy through the generation of high pressure and medium pressure steam, as the furnace effluent cools from the furnace outlet to the quench tower inlet. The process gas is normally then fed to a quench tower wherein the process gas is further cooled by direct contacting with quench water.

Conventional steam cracking systems have been effective for cracking high-quality feedstocks which contain a large fraction of light volatile hydrocarbons, such as gas oil and naphtha. However, steam cracking economics sometimes favor cracking lower cost feedstocks containing resids such as, by way of non-limiting examples, atmospheric residue, e.g., atmospheric pipe still bottoms, and crude oil. Crude oil and atmospheric residue often contain high molecular weight, non-volatile components with boiling points in excess of 595° C. (1100° F.). The non-volatile components of these feedstocks lay down as coke in the convection section of conventional pyrolysis furnaces. Only very low levels of non-volatile components can be tolerated in the convection section downstream of the point where the lighter components have fully vaporized. Cracking heavier feeds, such as kerosenes and gas oils, produces large amounts of tar, which leads to rapid coking in the radiant section of the furnace, often requiring costly shutdowns for cleaning.

Steam crackers designed to operate on gaseous feedstocks, while limited in feedstock flexibility, require significantly lower investment when compared to liquid feed crackers designed for naphtha and/or heavy feedstocks that produce higher amounts of tar and byproducts. However, as may be appreciated, when the price of natural gas is high relative to crude, gas cracking tends to be disadvantaged when compared with the cracking of virgin crudes and/or condensates, or the distilled liquid products from those feeds. (e.g., naphtha, kerosene, field natural gasoline, etc). In such an economic environment, it would be desirable to extend the range of useful feedstocks to include liquid feedstocks that yield higher levels of tar.

Advantaged steam cracking feeds frequently contain asphaltenes, which lay down as coke in the convection section of conventional pyrolysis furnaces. Contaminated condensates and full range virgin gas oils (FRVGO) with up to 400 ppm asphaltenes are typical of such advantaged feeds. However, feeds with greater than 100 ppm asphaltenes cause the thickness of the coke layer to increase rapidly in part because the coke produced by the asphaltenes typically is found within a few rows of the heat exchange tubes of the convection section. Since pressure drop is a strong function of tubing diameter, a fast growing coke layer causes the convection section pressure drop to increase rapidly. For example, a one-half inch layer of coke in a five inch diameter tube triples the pressure drop across the tube, while the same one-half inch layer of coke in a three inch diameter tube increases the pressure drop by nine times. As such, it would be desirable to have an improved process for decoking a furnace for cracking a hydrocarbon feed to facilitate the use of advantaged steam cracking feeds.

G.B. Patent No. 1,306,962 proposes a process for thermally cracking hydrocarbons wherein on-stream decoking is employed. It is asserted that an advantage of more frequent decoking is that decoking will be accomplished more readily since the coke will not have had a chance to calcine over a long period. It is believed that the process proposed relates to decoking a radiant section of a furnace, rather than dealing with the unique issues of convection section decoking.

U.S. Pat. No. 5,536,390 proposes the thermal decoking of cracking gas coolers that operate with low gas pressure. This is said to be accomplished by controlling the temperature of a cleaning gas delivered to the cooler. The temperature control is said to be achieved by mixing a cleaning gas, which has been heated in a cracking oven, with a stream of relatively cool cleaning gas upstream of the cooler.

U.S. Patent Publication No. 2006/0249428 proposes a process for steam cracking heavy hydrocarbon feedstocks containing non-volatile hydrocarbons. The process includes the steps of heating the heavy hydrocarbon feedstock, mixing the heavy hydrocarbon feedstock with a fluid and/or a primary dilution steam stream to form a mixture, flashing the mixture to form a vapor phase and a liquid phase, and varying the amount of the fluid and/or the primary dilution steam stream mixed with the heavy hydrocarbon feedstock in accordance with at least one selected operating parameter of the process, such as the temperature of the flash stream before entering the flash drum.

Despite these advances in the art, there is a need for an improved process for decoking a furnace for cracking a hydrocarbon feed.

SUMMARY OF THE INVENTION

In one aspect, provided is a process for decoking a convection section of a furnace for cracking a hydrocarbon feed, the furnace comprising a radiant section having burners that generate radiant heat and hot flue gas, and the convection section having at least one heat exchange tube for conveying the hydrocarbon feed. The process includes the step of establishing a flue gas temperature within the convection section of the furnace immediately adjacent the at least one convection section heat exchange tube so as to effect a film surface temperature of less than about 540° C. (1000° F.) within at least one convection section heat exchange tube, wherein the flue gas temperature establishing step is effective to decoke the at least one convection section heat exchange tube.

In another aspect, the process further includes the steps of interrupting the flow of hydrocarbon feed to the at least one convection section heat exchange tube; passing an air/steam decoking feed mixture having a first air/steam ratio through the at least one convection section heat exchange tube; and increasing the air/steam decoking feed mixture temperature entering the convection section to decoke an upper portion of the convection section.

In yet another aspect, the process further includes the steps of reducing the air/steam ratio of the air/steam decoking feed mixture to a second air/steam ratio prior to the step of increasing the air/steam decoking feed mixture temperature entering the convection section.

In still yet another aspect, the process is conducted at intervals sufficient to prevent extensive crosslinking of the coke.

In a further aspect, the furnace further comprises a steam superheater capable of being supplied with a stream of desuperheater water, and the step of increasing the air/steam decoking feed mixture temperature entering the convection section includes the step of reducing the supply of desuperheater water to the steam superheater In a yet further aspect, provided is a process for decoking a furnace for cracking a hydrocarbon feed, the furnace comprising a radiant section having burners that generate radiant heat and hot flue gas, and a convection section at least one having heat exchange tube for conveying the hydrocarbon feed, the convection section having upper, middle and lower portions thereof. The process includes the steps of taking the at least one heat exchange tube off stream by halting the flow of hydrocarbon feed thereto; passing an air/steam decoking feed mixture having a first air/steam ratio through the at least one heat exchange tube, and increasing the air/steam decoking feed mixture temperature entering the convection section to decoke the upper portion of the convection section, wherein the process is conducted for a period of time effective for decoking the at least one heat exchange tube.

In a further aspect, provided is a process for cracking hydrocarbon feed in a furnace, the furnace comprising a radiant section having burners that generate radiant heat and hot flue gas, and a convection section having at least one heat exchange tube for conveying the hydrocarbon feed, the convection section having upper, middle and lower portions thereof. The process includes the steps of preheating the hydrocarbon feed in the heat exchange tubes in the convection section by indirect heat exchange with the hot flue gas from the radiant section to provide preheated feed, heating the feed mixture in the at least one heat exchange tube in the convection section by indirect heat transfer with hot flue gas from the radiant section to form a heated feed mixture, taking at least one heat exchange tube off stream by halting the flow of hydrocarbon feed thereto, passing an air/steam decoking feed mixture having a first air/steam ratio through the at least one heat exchange tube, and increasing the air/steam decoking feed mixture temperature entering the convection section to decoke the upper portion of the convection section.

These and other features will be apparent from the detailed description taken with reference to accompanying drawings.

BRIEF DESCRIPTION OF THE DRAWING

The invention is further explained in the description that follows with reference to the drawing illustrating, by way of non-limiting examples, various embodiments of the invention wherein:

The FIGURE illustrates a schematic flow diagram of a process as disclosed herein employed with a pyrolysis furnace, with particular emphasis on the convection section of the furnace.

DETAILED DESCRIPTION OF PREFERRED EMBODIMENTS

Various aspects will now be described with reference to specific embodiments selected for purposes of illustration. It will be appreciated that the spirit and scope of the process and system disclosed herein is not limited to the selected embodiments. Moreover, it is to be noted that the FIGURE provided herein is not drawn to any particular proportion or scale, and that many variations can be made to the illustrated embodiments. Reference is now made to the figures, wherein like numerals are used to designate like parts throughout.

When an amount, concentration, or other value or parameters is given as a list of upper preferable values and lower preferable values, this is to be understood as specifically disclosing all ranges formed from any pair of an upper preferred value and a lower preferred value, regardless whether ranges are separately disclosed.

Feedstocks that may be employed herein may be any feedstock adapted for cracking insofar as they may be cracked into various olefins, and may contain heavy fractions such as high-boiling fractions and evaporation residuum fractions. Such feedstocks also include condensates and full range virgin gas oils (FRVGO). The liquid feedstocks that may be employed herein include, not only those heavy fraction-containing feedstocks adapted for cracking such as condensate, but also those having an appropriate proportion of high-quality feed stocks such as naphtha blended thereto.

Referring now to the FIGURE, a pyrolysis furnace 10 includes a lower radiant section 12, an intermediate convection section 14 and an upper flue gas exhaust section 16. In the radiant section 12, radiant burners (not shown) provide radiant heat to a hydrocarbon feed to produce the desired products by thermal cracking of the feed. The burners generate hot gas that flows upwardly through convection section 14 and then out of the furnace 10 through flue gas exhaust section 16.

As shown in the FIGURE, hydrocarbon feed 18 enters an upper portion of the convection section 14 where it is preheated. The preheating of the hydrocarbon feed can take any form known by those of ordinary skill in the art. Generally, the heating includes indirect contact of the feed 18 in the upper convection section 14 of the furnace 10 with hot flue gases from the radiant section 12 of the furnace 10. This can be accomplished, by way of non-limiting example, by passing the feed 18 through heat exchange tubes 20 located within the convection section 14 of the furnace 10. The preheated feed 22 has a temperature between about 95° C. to about 315° C. (about 200° F. to about 600° F.) or between about 150° C. to about 260° C. (about 300° F. to about 500° F.) or between about 175° C. to about 260° C. (about 350° F. to about 500° F.).

After the preheated hydrocarbon feed 18 exits the convection section 14 at 22, water 24 and dilution steam 26 are added thereto to form a mixture. Water 24 is added to the preheated feed 18 in an amount of from at least about 1% to 100% based on the total amount of water 24 and dilution steam 26 added by weight or an amount of at least about 3% (i.e., about 3% to about 100% water) based on water 24 and dilution steam 26 by weight or at least about 10% or at least about 30%, based on water 24 and dilution steam 26 by weight. It is understood that, in accordance with one form, 100% water could be added to the hydrocarbon feed 18 such that no dilution steam is added. The sum of the water flow and dilution steam flow provides the total desired reaction zone $H_2O$ required to achieve the desired hydrocarbon partial pressure.

As shown, water 24 may be added to the preheated feed 22 prior to addition of dilution steam 26. It is believed that this order of addition may reduce undesirable pressure fluctuations in the process stream originating from mixing the hydrocarbon feed 22, water 24 and dilution steam 26. As may be appreciated by those skilled in the art, such fluctuations are commonly referred to as a water-hammer or steam-hammer. While the addition of water 24 and dilution steam 26 to the preheated hydrocarbon feed 22 could be accomplished using any known mixing device, it is preferred to use a sparger assembly 28. Water 24 is preferably added in a first sparger 30. As shown, first sparger 30 comprises an inner perforated conduit 32 surrounded by an outer conduit 34 so as to form an annular flow space 36 between the inner and outer conduits 32 and 34, respectively. The preheated hydrocarbon feed 22 flows through an annular flow space. Also preferably, water 24 flows through the inner perforated conduit 32 and is injected into the preheated hydrocarbon feed 22 through the openings (perforations) shown in inner conduit 32.

Dilution steam 26 may be added to the preheated hydrocarbon feed 22 in a second sparger 38. As shown, second sparger 38 includes an inner perforated conduit 40 surrounded by an outer conduit 42 so as to form an annular flow space 44 between the inner and outer conduits 40 and 42, respectively. The preheated hydrocarbon feed 22 to which the water 24 has been added flows through the annular flow space 44. Thereafter, dilution steam 26 flows through the inner perforated conduit 40 and is injected into the preheated hydrocarbon feed 22 through the openings (perforations) shown in inner conduit 40.

In another form, the first and second spargers 30 and 38, respectively, are part of a sparger assembly 28, as shown, in which the first and second spargers 30 and 38, respectively, are connected in fluid flow communication in series. The first and second spargers 30 and 38 are interconnected in fluid flow communication in series by fluid flow interconnector 46.

As further illustrated, upon exiting the sparger assembly 28, the mixture 48 of hydrocarbon feed 22, water 24 and dilution steam 26 flows back into furnace 10 wherein the mixture 48 is further heated in a lower portion of convection section 14. The further heating of the hydrocarbon feed can take any form known by those of ordinary skill in the art. The further heating may include indirect contact of the feed in the lower convection section 14 of the furnace 10 with hot flue gases from the radiant section 12 of the furnace. This can be accomplished, by way of non-limiting example, by passing the feed through heat exchange tubes 50 located within the convection section 14 of the furnace 10. Following the additional heating of the mixture at 50, the resulting heated mixture exits the convection section at 52 and then flows to the radiant section of the furnace for thermal cracking of the hydrocarbon. The heated feed to the radiant section may have a temperature between about 425° C. to about 760° C. (about 800° F. to about 1400° F.) or about 560° C. to about 730° C. (about 1050° F. to about 1350° F.).

As mentioned above, advantaged steam cracking feeds frequently contain asphaltenes, which will lay down as coke in the convection section 14 of furnace 10 as feed/steam mixture reaches its dry point. Contaminated condensates and full range VGOs (FRVGO) with up to 400 ppm asphaltenes are typical advantaged feeds. However, feeds with greater than 100 ppm asphaltenes cause the thickness of the coke layer to increase rapidly in part because the asphaltenes lay down in only five convection rows of heat exchange tubes 20. For light feedstocks, this occurs in the upper portion of convection section 14.

The rate of coking varies with the type of feed employed but nevertheless is continuous and, therefore, the coke builds up and reduces the effective cross-sectional area of the tube, thereby necessitating higher pressures to maintain a constant throughput. For example, a one-half inch layer of coke in a five inch diameter tube triples the pressure drop across the tube, while the same one-half inch layer of coke in a three inch diameter tube increases the pressure drop by nine times.

Since coke is an effective insulator, its formation on tube walls must be accompanied by a sharp increase in furnace tube temperature in order to maintain cracking efficiency. High operating temperatures, however, result in a decrease in tube life, which limits the practical temperature that can be employed, as well as the ultimate conversion and yield.

During the subsequent decoke, the steam/air mixture in the upper convection section 14 may be too cold to burn coke. In this case, coke can only be removed by a cold shutdown of furnace 10, cutting off the convection return bends, hydroblasting the coke, re-welding the return bends and finally re-starting furnace 10. As may be appreciated by those skilled in the art, this is an expensive and time-consuming process.

To address these issues, in one form, a process for decoking a convection section 14 of a furnace 10 for cracking a hydrocarbon feed is provided, the furnace 10 including a radiant section 12 having burners (not shown) that generate radiant heat and hot flue gas, and convection section 14 having at least one heat exchange tube 20 for conveying the hydrocarbon feed. The process includes the step of establishing a flue gas temperature within convection section 14 of the furnace 10, immediately adjacent the at least one convection section heat exchange tube 20 so as to effect a film surface temperature of less than about 540° C. (about 1000° F.) within at least one convection section heat exchange tube 20, wherein said flue gas temperature establishing step is effective to decoke the at least one convection section heat exchange tube 20. The flue gas temperature so established within the convection section may be at least about 540° C. (about 1000° F.).

In practice, one or more tubes 20 are taken off stream (with or without shutting down the furnace 10) by cutting out the normal feed thereto and passing a decoking feed through the tube or tubes 20 in sufficient amount to remove the coke from the interior of the tubes. After decoking, the tube or tubes 20 are returned to normal flow by cutting out the decoking feed and returning the decoked tube or tubes to normal service.

In another form, the process further includes the steps of interrupting the flow of hydrocarbon feed to the at least one convection section heat exchange tube, passing an air/steam decoking feed mixture having a first air/steam ratio through the at least one convection section heat exchange tube and increasing the air/steam decoking feed mixture temperature entering the convection section to decoke an upper portion of the convection section.

Convection section coke can be burned off at as low as about 850° F. film temperature. Burning coke in the upper zones of convection section 14 is accomplished by adjusting the decoke flue gas temperature and burning the coke in tubes 20 located above the high pressure steam superheater bank 82. To yield a 455° C. (850° F.) film temperature during decoking a flue gas temperature of about 540° C. (about 1000° F.) to about 595° C. (about 1100° F.) is required.

In yet another form, the process further includes the steps of reducing the air/steam ratio of the air/steam decoking feed mixture to a second air/steam ratio prior to the step of increasing the air/steam decoking feed mixture temperature entering the convection section. Although a low air/steam ratio reduces combustion kinetics, it also prevents temperature runaways. Yet sufficiently high combustion rates are still possible at a higher temperature when employing a low air/steam ratio.

In another form, the step of increasing the air/steam decoking feed mixture temperature entering the convection section includes the step of increasing flue gas oxygen content. As may be appreciated, significantly higher crossover temperatures and film temperatures may be achieved by increasing the flue gas $O_2$ content and firing. For example, during decoking, increasing the flue gas $O_2$ content from 11.8 to 12.2 vol. %, wet, increases firing by only 10%, but increases the crossover temperature by about 10° C. (about 50° F.) and the flue gas and film temperature in the upper convection section 14 by about 25° C. (about 75° F.). In the use of this form, flue gas oxygen measuring instrumentation 88 can be employed. Flue gas oxygen measuring instrumentation 88 should cover the entire range of 0 to 15% $O_2$, rather than the more common range of 0 to 10% $O_2$. In this form, it may be beneficial to employ a low alloy steel in the fabrication of the convection section heat exchange tubes 20 rather than carbon steel, to accommodate the hotter flue gas.

In still yet another form, the decoking scheduling is modified to allow burning of the coke to assure that the coke is hydrogen-rich and to prevent extensive crosslinking of the coke. Although this form may reduce furnace run length, as may be appreciated by those skilled in the art, this is not necessary. For example, furnace 10 can crack a relatively clean feed for the majority of a run; then be switched to a light feedstock contaminated with resid.

In a further form, the operating procedure is modified to include contaminated feeds that lay down coke in the convection section where the film temperature during decoking is about 455° C. (850° F.) rather than about 540° C. (about 1000° F.). For a typical quench header furnace, this means that the coke will lay down about two rows higher in the convection section 14.

In a still further form, the furnace further comprises a steam superheater 82 capable of being supplied with a stream of desuperheater water 84, and the step of increasing the air/steam decoking feed mixture temperature entering the convection section 12 includes the step of reducing the supply of desuperheater water to the steam superheater 82. As may be appreciated, the operation of the high pressure steam superheater 82 may be modified, the design of the steam superheater 82 may be modified, or both may be modified, to yield a hotter flue gas above the steam superheater 82. Hotter flue gas temperature requires reducing the heat (Q) absorbed by the steam superheater 82. Since $Q=U_oA_o\Delta T_{Im}$, with $O_oA_o$, being nearly constant, reducing $\Delta T_{Im}$ is the only way to reduce the heat absorbed. Reducing $\Delta T_{Im}$ requires increasing the high pressure steam temperature throughout the steam superheater 82.

In one form, $\Delta T_{Im}$ is reduced by turning off the desuperheater water 84 at valve 86 and/or allowing a portion of the saturated high pressure steam supplied by line 80 to bypass the steam superheater 82 through line 90, through the use of valves 90 and 94.

In a yet further form, provided is a process for decoking a furnace 10 for cracking a hydrocarbon feed, the furnace 10 comprising a radiant section 12 having burners (not shown) that generate radiant heat and hot flue gas, and a convection section 14 having at least one heat exchange tube 20 for conveying the hydrocarbon feed, the convection section 14 having upper, middle and lower portions thereof. The process includes the steps of taking the at least one heat exchange tube 20 off stream by halting the flow of hydrocarbon feed thereto; passing an air/steam decoking feed mixture having a first air/steam ratio through the at least one heat exchange tube 20, and increasing the air/steam decoking feed mixture temperature entering the convection section 10 to decoke the upper portion of the convection section 14, wherein the process is conducted for a period of time effective for decoking the at least one heat exchange tube 20.

In a still yet further aspect, provided is a process for cracking hydrocarbon feed in a furnace 10, the furnace 10 comprising a radiant section 12 having burners (not shown) that generate radiant heat and hot flue gas, and a convection section 14 having at least one heat exchange tube 20 for conveying the hydrocarbon feed, the convection section 14 having upper, middle and lower portions thereof. The process includes the steps of preheating the hydrocarbon feed in the at least one heat exchange tube 20 in the convection section 14 by indirect heat exchange with the hot flue gas from the radiant section 12 to provide preheated feed, heating the feed mixture in heat exchange tubes 20 in the convection section 14 by indirect heat transfer with hot flue gas from the radiant section 12 to form a heated feed mixture, taking at least one heat exchange tube 20 off stream by halting the flow of hydrocarbon feed thereto, passing an air/steam decoking feed mixture having a first air/steam ratio through the at least one heat exchange tube 20, and increasing the air/steam decoking feed mixture temperature entering the convection section 12 to decoke the upper portion of the convection section 14.

Additionally, the FIGURE further illustrates a control system having utility in the processes disclosed herein. The process temperature provides an input to a controller 54 which controls the flow rate of water via a flow meter 56 and a control valve 58. The water then enters the sparger assembly 28. When the process temperature is too high, controller 54 increases the flow of water 24.

Controller 54 also sends the flow rate signal to a computer control application schematically shown at 60, which determine the dilution steam flow rate as detailed below. A pre-set flow rate of the hydrocarbon feed 18 is measured by flow meter 62, which is an input to controller 64, which in turn sends a signal to feed control valve 66. Controller 64 also sends the feed rate signal to a computer control application 68, which determines the total $H_2O$ to the radiant section 12 by multiplying the feed rate by a pre-set total $H_2O$ to feed rate ratio. The total $H_2O$ rate signal is the second input to computer application 60. Computer application 60 subtracts the water flow rate from the total $H_2O$ rate; the difference is the set point for the dilution steam controller 70. Flow meter 72 measures the dilution steam rate, which is also an input to the controller 70. When water flow rate increases, as discussed above, the set point inputted to the dilution steam controller 70 decreases. Controller 70 then instructs control valve 74 to reduce the dilution the steam rate 76 to the new set point. When the process temperature 78 is too low the control scheme instructs control valve 58 to reduce water rate and instructs control valve 74 to increase the steam rate while maintaining constant total $H_2O$ rate.

Example

In this example $\Delta T_{Im}$ is reduced by turning off the desuperheater water and/or allowing a portion of the saturated high pressure steam to bypass the steam superheater (SSH). The Table below summarizes the performance of these two options for a furnace during decoking.

TABLE

| | Normal SSH operations | No desuperheater water | No desuperheater water/ 50% HP steam bypass |
|---|---|---|---|
| SSH duty, MBtu/hr | 16 | 14 | 8.5 |
| SSH duty, Mkg-m/hr | 1721 | 1505 | 914 |
| SSH outlet temp. | 504° C. (940° F.) | 599° C. (1110° F.) | 677° C. (1250° F.) |
| Flue temp. above SSH | 404° C. (760° F.) | 435° C. (815° F.) | 538° C. (1000° F.) |
| Film temp. above SSH | 379° C. (715° F.) | 407° C. (765° F.) | 493° C. (920° F.) |

As shown above, simply turning off the desuperheater water does not reduce the heat absorbed by the steam superheater sufficiently to burn coke, since the film temperature is only 407° C. (765° F.) in the row above the steam superheater. However, turning off the desuperheater water and bypassing half of the high pressure steam does reduce the heat absorbed by the steam superheater sufficiently to burn coke. This occurs because the steam superheater absorbs only about one-half the heat absorbed during normal operations. The film temperature above the steam superheater is 493° C. (920° F.), which is more than adequate to burn coke.

It would be expected that the bypass option will require steam superheater tubes that are thicker and possess better metallurgy and may also require alloy steel in the process rows above the steam superheater. In addition, controlling the steam superheater outlet temperature is more difficult during bypass operations. However, bypassing only at the end of a decoke process mitigates the effect that this control issue has on the plant high pressure steam system.

All patents, test procedures, and other documents cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

What is claimed is:

1. A process for decoking a convection section of a furnace for cracking a hydrocarbon feed, the furnace comprising a radiant section having burners that generate radiant heat and hot flue gas, and the convection section having at least one heat exchange tube for conveying the hydrocarbon feed, said process comprising the step of:

interrupting the flow of hydrocarbon feed to the at least one convection section heat exchange tube;

passing an air/steam decoking feed mixture having a first air/steam ratio through the at least one convection section heat exchange tube; and increasing the air/steam decoking feed mixture temperature within the tube entering the convection section to decoke;

establishing a flue gas temperature within the convection section of the furnace immediately adjacent the at least one convection section heat exchange tube so as to effect a film surface temperature of less than about 540° C. within at least one convection section heat exchange tube, wherein said flue gas temperature establishing step is effective to decoke the at least one convection section heat exchange tube;

and wherein the furnace further comprises a steam superheater disposed below the at least one convection section heat exchange tube in the furnace and capable of being supplied with a stream of desuperheater water, and wherein said step of increasing the air/steam decoking feed mixture temperature entering the convection section includes the step of reducing the supply of desuperheater water to the steam superheater during the decoking of the upper convection section of the furnace.

2. The process of claim 1, wherein the flue gas temperature so established within the convection section of the furnace immediately adjacent the at least one convection section heat exchange tube is at least about 540° C.

3. The process of claim 1, wherein the film surface temperature of the at least one convection section heat exchange tube is at least about 455° C.

4. The process of claim 1, wherein the steps of passing an air/steam decoking feed mixture and increasing the air/steam decoking feed mixture temperature are conducted for a period of time effective for decoking the at least one convection section heat exchange tube.

5. The process of claim 4, further comprising the step of reducing the air/steam ratio of the air/steam decoking feed mixture to a second air/steam ratio prior to the step of increasing the air/steam decoking feed mixture temperature entering the convection section.

6. The process of claim 1, wherein the heat exchange tubes of the convection section are formed of low alloy steel.

7. The process of claim 1, wherein the process is conducted at intervals sufficient to prevent extensive crosslinking of the coke.

8. The process of claim 1, wherein the flue gas temperature is between about 540° C. and about 595° C.

9. A process for decoking a furnace for cracking a hydrocarbon feed, the furnace comprising a radiant section having burners that generate radiant heat and hot flue gas, and a convection section having at least one heat exchange tube for conveying the hydrocarbon feed, the convection section having upper, middle and lower portions thereof, the process comprising the steps of:

(a) taking the at least one heat exchange tube disposed in the middle or upper sections of the convection section off stream by halting the flow of hydrocarbon feed thereto;

(b) passing an air/steam decoking feed mixture having a first air/steam ratio through the at least one heat exchange tube; and (c) increasing the air/steam decoking feed mixture temperature entering the convection section to decoke the upper portion of the convection section, wherein steps (b) and (c) are conducted for a period of time effective for decoking the at least one heat exchange tube; and wherein the furnace further comprises a steam superheater capable of being supplied with a stream of desuperheater water; and wherein said step of increasing the air/steam decoking feed mixture temperature entering the upper convection section includes the step of reducing the supply of desuperheater water to the steam superheater.

10. The process of claim 9, wherein said step of increasing the air/steam decoking feed mixture temperature entering the convection section includes the step of increasing flue gas oxygen content.

11. The process of claim 9, wherein said step of increasing the air/steam decoking feed mixture temperature entering the convection section includes the step of increasing burner firing rate for the radiant section burners.

12. The process of claim 9, wherein the upper and middle convection section heat exchange tubes are formed of low alloy steel.

13. The process of claim 9, wherein said step of increasing the air/steam decoking feed mixture temperature entering the convection section includes the step of eliminating the supply of desuperheater water to the steam superheater.

14. The process of claim 13, wherein said step of increasing the air/steam decoking feed mixture temperature entering the convection section also includes the step of bypassing a portion of steam supplied to the steam superheater.

15. The process of claim 13, wherein the flue gas temperature is between about 540° C. and about 595° C. and is effective to decoke the at least one convection section heat exchange tube.

16. The process of claim 15, wherein the at least one convection section heat exchange tube has a film surface temperature of at least about 455° C.

17. A process for cracking hydrocarbon feed in a furnace, the furnace comprising a radiant section having burners that generate radiant heat and hot flue gas, and a convection section having at least one heat exchange tube for conveying the hydrocarbon feed, the convection section having upper, middle and lower portions thereof, the process comprising the steps of:

(a) preheating the hydrocarbon feed in the heat exchange tubes in the convection section by indirect heat exchange with the hot flue gas from the radiant section to provide preheated feed;

(b) heating the feed mixture in the at least one heat exchange tube in the convection section by indirect heat transfer with hot flue gas from the radiant section to form a heated feed mixture;

(c) taking the at least one heat exchange tube disposed in the middle or upper sections of the convection section off stream by halting the flow of hydrocarbon feed thereto;

(d) passing an air/steam decoking feed mixture having a first air/steam ratio through the at least one heat exchange tube; and (e) increasing the air/steam decoking feed mixture temperature entering the convection section to decoke the upper portion of the convection section, wherein steps (d) and (e) are conducted for a period of time effective for decoking the at least one heat exchange tube and wherein the furnace further comprises a steam superheater capable of being supplied with a stream of desuperheater water; and wherein said step of increasing the air/steam decoking feed mixture temperature entering the convection section includes the step of reducing the supply of desuperheater water to the steam superheater during the decoking of the upper convection section of the furnace.

18. The process of claim 17, further comprising the step of reducing the air/steam ratio of the air/steam decoking feed mixture to a second air/steam ratio prior to said step of increasing the air/steam decoking feed mixture temperature entering the convection section.

19. The process of claim 17, wherein the upper and middle convection section heat exchange tubes are formed of low alloy steel.

20. The process of claim 17, wherein the flue gas temperature is between about 540° C. and about 595° C.

21. The process of claim 20, wherein the flue gas temperature is effective to decoke the at least one convection section heat exchange tube.

22. The process of claim 20, wherein the at least one convection section heat exchange tube has a film surface temperature of at least about 455° C.

* * * * *